US009388818B2

(12) United States Patent
Wetzl et al.

(10) Patent No.: US 9,388,818 B2
(45) Date of Patent: Jul. 12, 2016

(54) SIDE CHANNEL BLOWER FOR A VEHICLE HEATER

(75) Inventors: Andreas Wetzl, Wemau (DE); Michael Haefner, Stuttgart (DE); Andreas Collmer, Aichwald (DE); Wolfgang Pfister, Esslingen (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 1043 days.

(21) Appl. No.: 13/238,293

(22) Filed: Sep. 21, 2011

(65) Prior Publication Data

US 2012/0241529 A1 Sep. 27, 2012

(30) Foreign Application Priority Data

Sep. 21, 2010 (DE) ..... 10 2010 041 139

(51) Int. Cl.

| | |
|---|---|
| ***B60H 1/03*** | (2006.01) |
| ***F04D 13/06*** | (2006.01) |
| ***F24H 3/00*** | (2006.01) |
| ***F04D 25/16*** | (2006.01) |
| ***F04D 23/00*** | (2006.01) |

(52) U.S. Cl.

CPC ..... *F04D 25/166* (2013.01); *F04D 23/008* (2013.01)

(58) Field of Classification Search

CPC B60H 1/03; B60H 2001/2278; F04D 23/008; F04D 25/166; F24H 3/00; H02G 3/008

USPC ..... 237/12.3 C; 126/112

See application file for complete search history.

(56) References Cited

U.S. PATENT DOCUMENTS

| | | | | |
|---|---|---|---|---|
| 3,267,928 | A * | 8/1966 | Spooner | 126/110 B |
| 3,543,742 | A * | 12/1970 | Frankle et al. | 126/110 B |
| 3,814,961 | A * | 6/1974 | Nelson et al. | 310/87 |
| 4,211,365 | A * | 7/1980 | Friedl et al. | 237/12.3 C |

(Continued)

FOREIGN PATENT DOCUMENTS

| | | | |
|---|---|---|---|
| CN | 1904386 | A | 1/2007 |
| CN | 201288697 | Y | 8/2009 |

(Continued)

OTHER PUBLICATIONS

Wetzl, DE 102005046715 A1 English machine translation, Aug. 31, 2006.*

(Continued)

*Primary Examiner* — Alissa Tompkins
*Assistant Examiner* — Phillip E Decker
(74) *Attorney, Agent, or Firm* — McGlew and Tuttle, P.C.

(57) ABSTRACT

A side channel blower for a vehicle heater includes a blower housing area (14) with a delivery channel (18), which extends in a ring-shaped pattern around a central axis (A) and is open on an axial side (16). A motor housing area (26) integral with the blower housing area (14) accommodates an electric drive motor (30) with a drive shaft (36). A first delivery wheel covers the delivery channel on a first axial side of the blower housing area and is carried at a first end of the drive shaft. A control device housing area is integral with the blower housing area or/and the motor housing area and is provided with a circumferential wall and with a bottom wall and with an opening located opposite the bottom wall. A partial area of the bottom wall of the control device housing area is formed by the motor housing area.

20 Claims, 4 Drawing Sheets

(56) References Cited

U.S. PATENT DOCUMENTS

| | | | | | |
|---|---|---|---|---|---|
| 4,519,375 | A | * | 5/1985 | Galtz | 126/110 B |
| 4,519,772 | A | * | 5/1985 | Mittmann | 237/12.3 C |
| 4,718,602 | A | * | 1/1988 | Beck et al. | 237/12.3 C |
| 4,909,750 | A | * | 3/1990 | Neumann | 126/116 R |
| 4,940,041 | A | * | 7/1990 | Riedmaier et al. | 237/12.3 C |
| 4,976,463 | A | * | 12/1990 | Soo | 237/12.3 C |
| 5,012,070 | A | * | 4/1991 | Reed | 237/12.3 A |
| 5,618,186 | A | * | 4/1997 | Saka et al. | 439/76.2 |
| 5,727,730 | A | * | 3/1998 | Habijanec et al. | 237/12.3 C |
| 5,749,516 | A | * | 5/1998 | Humburg | 237/12.3 C |
| 6,034,352 | A | * | 3/2000 | Gortler et al. | 237/12.3 R |
| 6,724,983 | B1 | * | 4/2004 | Humburg et al. | 237/12.3 C |
| 6,743,012 | B2 | * | 6/2004 | Wolf | 237/12.3 C |
| 6,984,133 | B2 | * | 1/2006 | Naitou et al. | 439/76.2 |
| 7,055,760 | B2 | * | 6/2006 | Paul et al. | 237/12.3 C |
| 7,270,098 | B2 | * | 9/2007 | Young et al. | 123/142.5 R |
| 7,390,198 | B2 | * | 6/2008 | Oka et al. | 439/76.2 |
| 7,594,484 | B2 | | 9/2009 | Lavender et al. | |
| 2008/0304988 | A1 | * | 12/2008 | Asaka | 417/500 |

FOREIGN PATENT DOCUMENTS

| | | | | | |
|---|---|---|---|---|---|
| DE | 14 28 246 | A1 | | 1/1969 | |
| DE | 10 2005 046 715 | A1 | | 8/2006 | |
| EP | 1768217 | A1 | * | 3/2007 | H01R 13/627 |
| EP | 2 166 232 | A1 | | 3/2010 | |
| JP | 10285749 | A | * | 10/1998 | H02G 3/16 |
| JP | 2000092659 | A | * | 3/2000 | H02G 3/16 |

OTHER PUBLICATIONS

Schonwald, et al, DE 1428246 A1 English machine translation, Jan. 23, 1969.*

Gennat, et al, EP 2166232 A1 English machine translation, Mar. 24, 2010.*

* cited by examiner

SIDE CHANNEL BLOWER FOR A VEHICLE HEATER

CROSS REFERENCE TO RELATED APPLICATIONS

This application claims the benefit of priority under 35 U.S.C. §119 of German Patent Application DE 10 2010 041 139.6 filed Sep. 21, 2010, the entire contents of which are incorporated herein by reference.

FIELD OF THE INVENTION

The present invention pertains to a side channel blower for a vehicle heater, comprising a blower housing area with a delivery channel extending around a central axis in a ring-shaped pattern and being open on a first axial side; a motor housing area integral with the blower housing area for receiving an electric drive motor with a drive shaft; a first delivery wheel, which covers the blower housing area on the first axial side and is carried at a first end of the drive shaft; a control device housing area integral with the blower housing area and/or motor housing area with a circumferential wall and with a bottom wall and with an opening located opposite the bottom wall, wherein the opening is covered by a closing element.

BACKGROUND OF THE INVENTION

Such a side channel blower is known from DE 10 2005 046 715 A1. A ring-shaped or cylindrical wall, which forms essentially the motor housing area, extends integrally in this side channel blower from an essentially plate-shaped blower housing area with the delivery channel formed therein. An electric drive motor is arranged in the interior of this wall. The drive shaft of said electric drive motor carries at its free first end the delivery wheel that is located opposite the delivery channel and covers same. A wall, which extends approximately in the direction of a central axis beginning from the blower housing area, is provided at a side area of the blower housing area, i.e., to the side of the motor housing area. This wall forms a bottom wall for a control device housing area integral with the blower housing area. The control device housing area is open on the side and is covered by a closing element. A control device, which can control or regulate the operation of the side channel blower or even the operation of the vehicle heater equipped therewith, is provided in the control device housing area.

SUMMARY OF THE INVENTION

An object of the present invention is to provide a side channel blower for a vehicle heater with a simplified design and better space utilization.

This object is accomplished according to the present invention by a side channel blower for a vehicle heater, comprising a blower housing area with a delivery channel, which extends in a ring-shaped pattern around a central axis and is open on a first axial side; a motor housing area integral with the blower housing area for receiving an electric drive motor with a drive shaft; a delivery wheel, which covers the delivery channel on the first axial side of the blower housing area and is carried at a first end of the drive shaft; a control device housing area integral with the blower housing area and/or motor housing area with a circumferential wall and with a bottom wall and with an opening located opposite the bottom wall, wherein said opening is covered by a closing element.

Provisions are, furthermore, made for at least a partial area of the bottom wall of the control device housing area to be formed by the motor housing area.

The functions of the different housing areas are merged in the design of the side channel blower according to the present invention. This makes it possible to better utilize the space available for installation, because intermediate spaces, for example, between the motor housing area and the control device housing area can be avoided.

According to another advantageous aspect of the present invention, provisions may be made for at least one connector plug receptacle to be provided in the bottom wall and/or closing element. By integrating receptacles for the connector plug needed for the electric connection in the bottom wall and/or closing element, the space available for installation is likewise utilized efficiently. Thus, terminal plugs projecting far above the control device housing area or attached thereto from the outside can thus be avoided in the final installed state.

In order to achieve complete closure of the internal space area of the control device housing area especially also where a connection is to be established, it is proposed that at least one connector plug receptacle have a recess bottom area closing this connection towards the inside of the control device housing area.

Especially if different connections shall be established with a control device arranged in the control device housing area, it is advantageous if at least one connector plug receptacle each is provided in the bottom wall of the control device housing area on both sides of the motor housing area.

A connection of the closing element, which can be manufactured in a simple manner and nevertheless functions in a stable manner, is obtained by the closing element being able to be locked by a locking connection at the circumferential wall and/or the blower housing area to cover the opening.

According to another advantageous aspect of the present invention, provisions may be made for a spacer formation to be integrally provided at an end area facing away from the blower housing area at the motor housing area. By integrating the spacer formation into the motor housing area, an integral component is thus created, at which different functions or housing areas are provided. The attachment of additional components, which will then assume this function, can thus be avoided.

To make it possible to generate two air flows, namely, the combustion air flow, on the one hand, and the heating air flow, on the other hand, with the side channel blower according to the present invention, a second delivery wheel be provided at the second end area of the drive shaft.

Free rotation, especially of the second delivery wheel, in a housing surrounding this can be guaranteed by the spacer formation extending over the second delivery wheel.

The present invention pertains, furthermore, to a vehicle heater, comprising a burner area and a side channel blower according to the present invention for delivering combustion air into a combustion chamber of the burner area.

The present invention will be described in detail below with reference to the enclosed figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
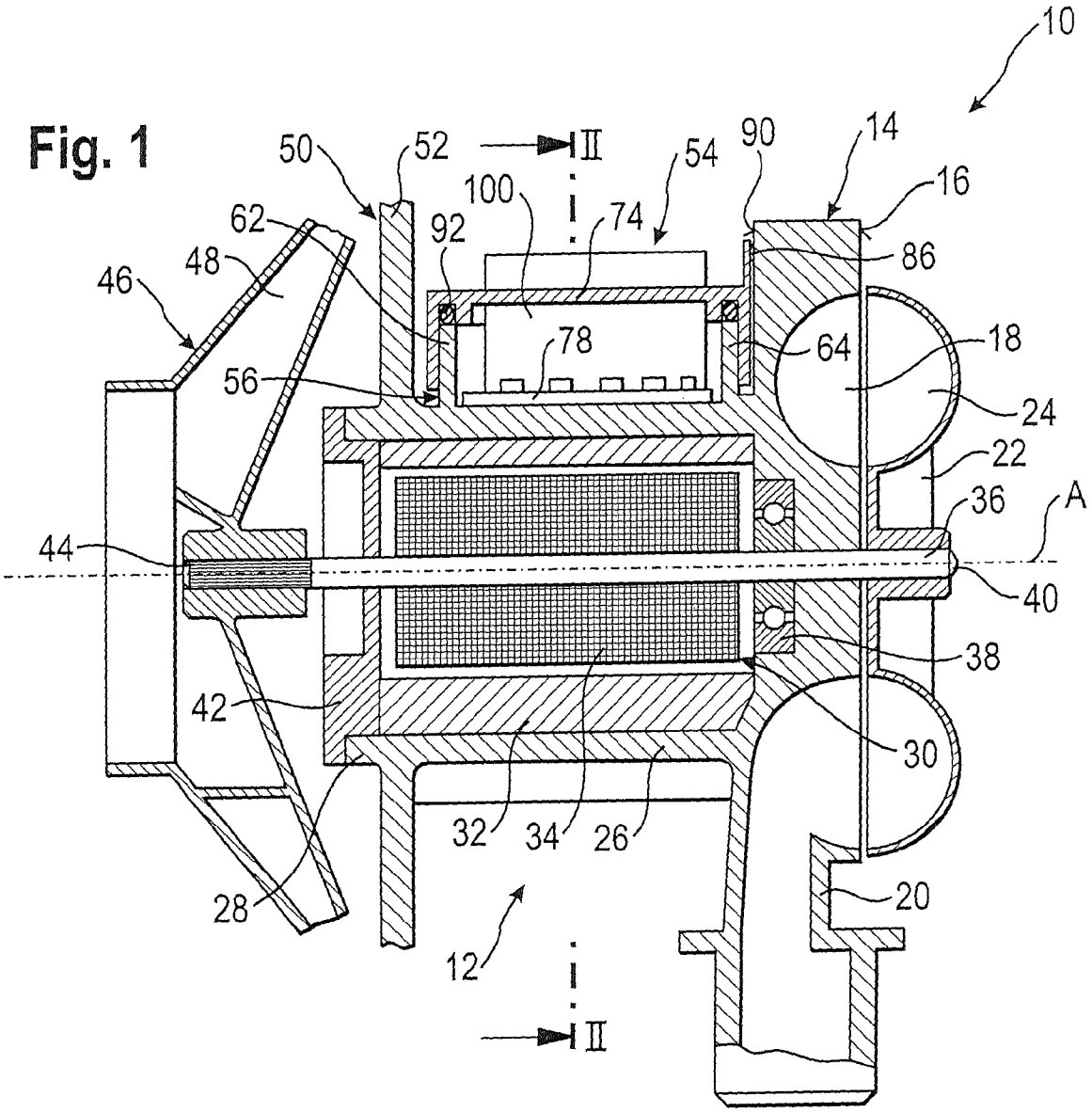
FIG. 1 is a longitudinal sectional view of a side channel blower, cut along a line I-I in FIG. 2.
Figure 2:
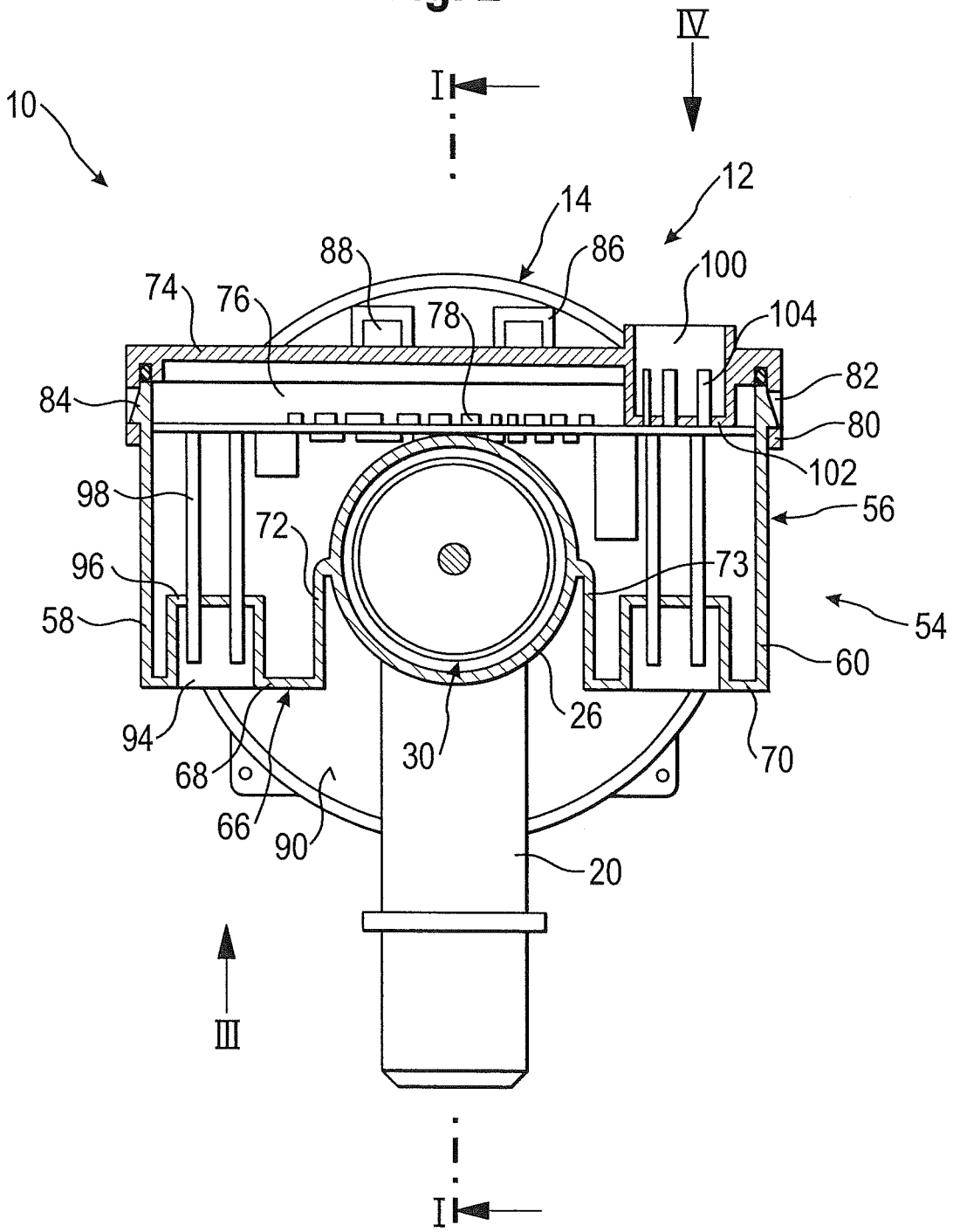
FIG. 2 is a cross-sectional view of a side channel blower, cut along a line II-II in FIG. 1.

Referring to the drawings in particular, a side channel blower for a vehicle heater is generally designated by 10 in FIGS. 1 and 2. This side channel blower 10 comprises a multifunctional housing generally designated by 12, at which different housing areas are provided as integral components each, as will be described below.

A blower housing area 14, which is essentially plate-shaped and is oriented at right angles to a central axis A, is provided on a first axial side 16 thereof with a delivery channel 18 extending around the central axis A in a ring-shaped pattern. A combustion air inlet attachment 20, via which the combustion air to be delivered enters the delivery channel 18, is provided at the area of the blower housing area 14, which said area is the lower area in FIG. 1 and FIG. 2. The combustion air is delivered in the circumferential direction along the delivery channel 18 under the delivery action of a combustion air delivery wheel 22, which is located opposite the first axial side 16 of the blower housing area 14 and covers the delivery channel 18, and which defines, together with the delivery channel 18, a volume area having a circular cross section for the combustion air to be delivered, and this combustion air leaves said delivery channel at an interruptor area or an outlet opening formed there. A plurality of delivery blades 24 following each other in the circumferential direction at the delivery wheel 22 are provided to achieve this delivery action.

A ring-shaped or essentially cylindrical motor housing area 26, designed integrally with the blower housing area 14, extends starting from said blower housing area 14. This motor housing area is axially open at an end area 28 located away from the blower housing area 14, so that an electric drive motor generally designated by 30 can be positioned in the motor housing area 26. A stator area 32 may be arranged here firmly in contact with the inner surface of the essentially cylindrical motor housing area 26. A rotor area 34, which is firmly carried at a drive shaft 36, is located inside the stator area 32. Drive shaft 36 is mounted in its area passing through the blower housing area 14 at the blower housing area 14 by means of a bearing 38 and carries the combustion air delivery wheel 22 in its first end area 40.

The motor housing area 26 is closed at the end area 28 by a closing element 42. Drive shaft 36 passes through an opening in the closing element 42 and can also be mounted therein. In its second end area 44, the drive shaft 36 carries a heating air delivery wheel 46 with a plurality of delivery blades 48 following each other in the circumferential direction. When the electric drive motor 30 is energized, the combustion air delivery wheel 22 is consequently driven to rotate to deliver the air necessary for the combustion into a burner area 210 with a combustion chamber 212 of a vehicle heater 200, while the heating air delivery wheel 46 is driven to rotate at the same time to deliver a heating air flow in the direction of central axis A over the multifunctional housing 12 from left to right in FIG. 1.

The multifunctional housing 12 is surrounded by a heating air flow housing not shown in the figures. To avoid a mutual contact between the heating air delivery wheel 46 and this heating air housing, a spacer formation 50 is provided integrally at the end area 28 of the motor housing area 26. This spacer formation 50 may be provided in a star-like manner with a plurality of spacer arms 52, which are arranged at spaced locations from each other in the circumferential direction and which extend radially outwardly in relation to the central axis A starting from the end area 28 of the motor housing area 26, doing so to such an extent that they radially extend over the delivery blades 48 of the heating air delivery wheel 46. A mutual contact between the heating air housing, not shown, and the delivery blades 48 is avoided hereby, especially if the heating air housing is deformed by applying pressure. It is, of course, possible to also use the spacer arms 52 as fastening means for this heating air housing.

A control device housing area 54 is provided as another, integral component of the multifunctional housing axially between the blower housing area 14 and the spacer formation 50. The control device housing area 54 is arranged such that the motor housing area 26 is essentially integrated in this. A circumferential wall 56 of the control device housing area 54 with two side walls 58, 60, which are essentially parallel to the central axis A and extend to the side thereof, and with two side walls 62, 64, which extend essentially at right angles to the central axis A and can be recognized in FIG. 1, is recognized especially in FIG. 2. The side walls 58, 60, 62, 64 form an essentially rectangular configuration.

The rectangular configuration formed by the side walls 58, 60, 62, 64 of the circumferential wall 56 is defined on one side by a bottom wall generally designated by 66. This bottom wall has, on both sides of the central axis A, bottom wall areas 68, 70 each, which are connected to the motor housing area 26 via respective connection wall areas 72, 73. This means that the motor housing area 26 provides essentially the bottom wall 66 together with the bottom wall areas 68, 70 and the connection wall areas 72, 73.

On the other side, the rectangular configuration formed by the side walls 58, 60, 62, 64 is closed or covered by a cover 74, acting in this embodiment as a closing element. Cover 74 closes an opening 76 formed in the control device housing area 54, via which access can be generally gained to a control device 78 arranged in the control device housing area 54 or via which said control device 78 can be inserted into the control device housing area 54. Cover 74 has an edge area 80 extending over the circumferential wall 56. For example, in association with the side walls 58, 60 and 62, the edge area 80 may have a plurality of recesses 82, in which respective locking projections 84 of a ramp-like design, engaging said side walls 58, 60, 62, can be positioned in order to lock the cover 74 at the control device housing area 54. Since the manufacture of such ramp-like locking projections 84 at the side wall 64 may be difficult, locking brackets 86 may be provided at the cover 74 where this covers the side wall 64. These locking brackets 86 extend in a direction opposite the edge area 80 and cooperate with locking projections 88, which are provided on a second axial side 90 of the blower housing area 14. It can be ensured in this manner that the cover 74 can be locked on all four sides with respect to the multifunctional housing 12 in a stable but nevertheless detachable manner.

To guarantee a sealed closure of the control device housing area 54, a sealing element 92, for example, an O-ring-like sealing element, which may be located opposite the front side of the circumferential wall 56 or in contact therewith, may be provided at cover 74.

Figure 3:
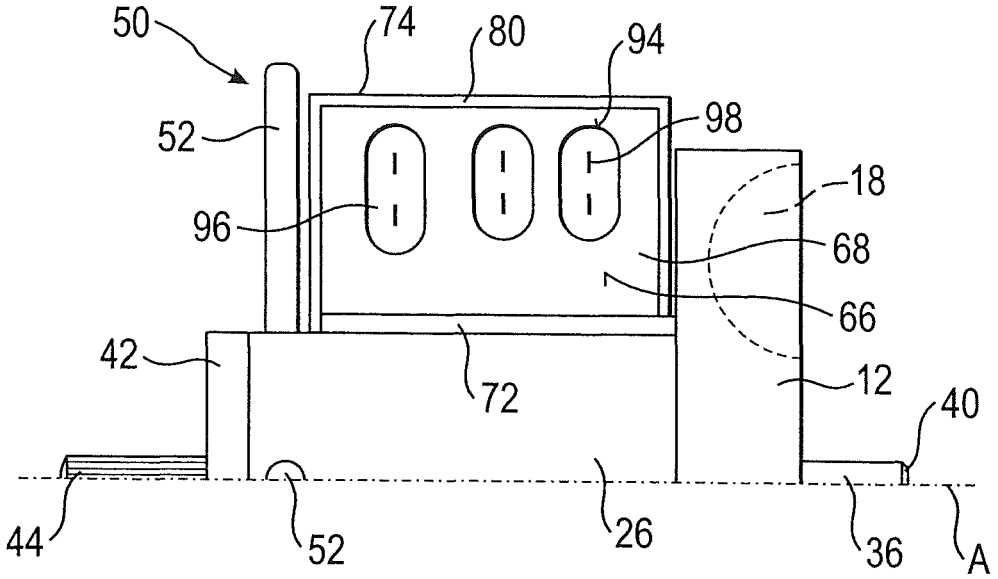
FIG. 3 is a partial longitudinal top view of the side channel blower according to FIGS. 1 and 2, viewed in direction III in FIG. 2.
Figure 4:
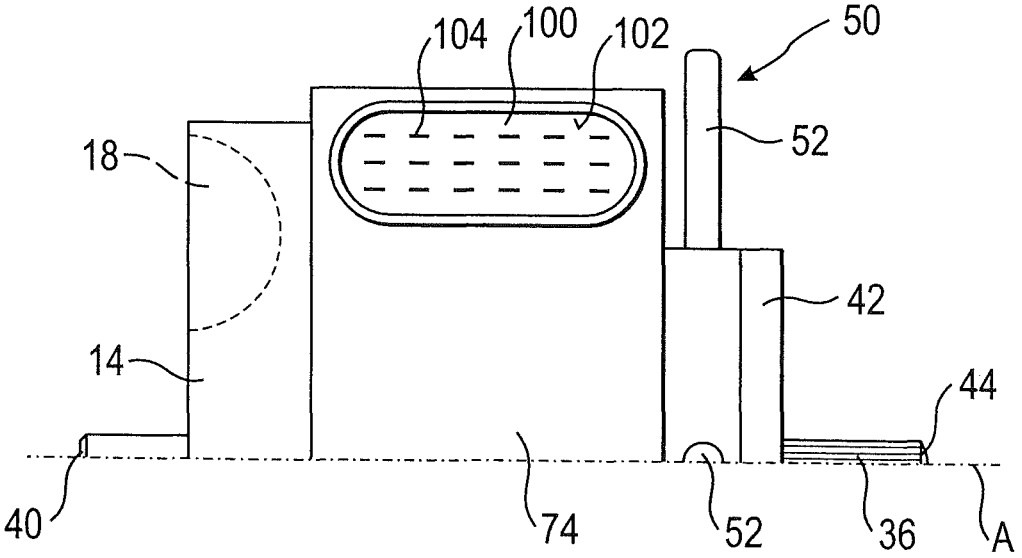
FIG. 4 is a partial longitudinal top view of the side channel blower according to FIGS. 1 and 2 as viewed in direction IV in FIG. 2.
Figure 5:
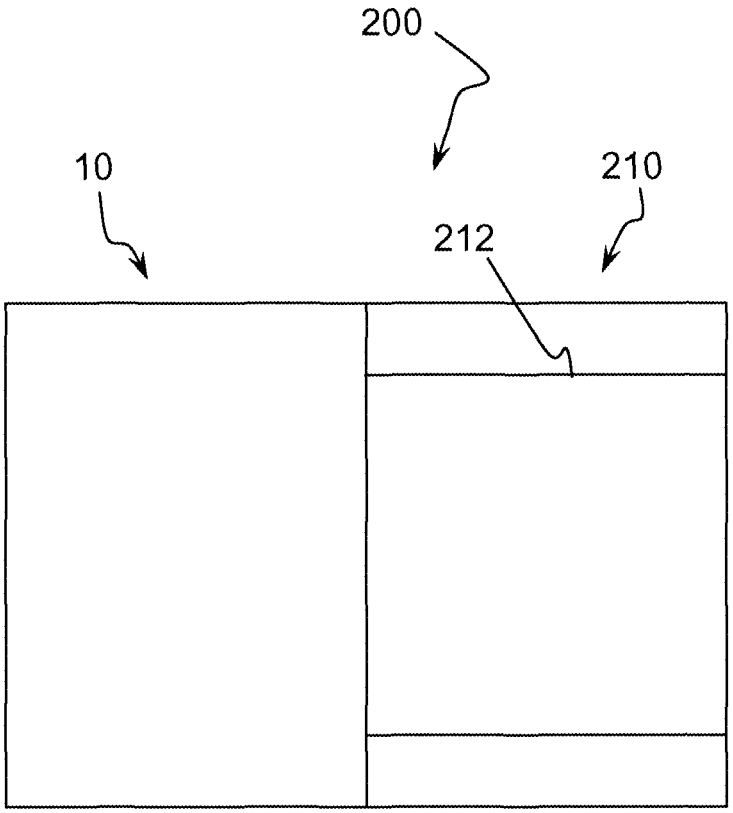
FIG. 5 is a schematic view of a vehicle heater with a burner area with a combustion chamber and the side channel blower.

Connector plug receptacles 94 may be formed in the bottom wall 66 in the bottom wall areas 68, 70 on both sides of the central axis A. As is shown in FIG. 3, these may have an elongated, rounded configuration and form setoffs, which are open towards the outside and are each defined by a recess bottom area 96 or closed towards the internal volume area of the control device housing area 54. The recess bottom areas 96 of the connector plug receptacles 94 thus form a partial area of the bottom wall 66 each. Connection contacts 98 originating from the control device 78 pass through the recess bottom areas 96 and are thus free for establishing an electric connection contact with a connector plug to be inserted into the respective connector plug receptacles 94.

As is shown in FIG. 3, the connector plug receptacles 94 may be designed with different dimensions and thus adapted to different connector plugs in order to ensure that there is an unambiguous association between the connector plug and the connector plug receptacle. For example, connector plugs for connecting an electric power supply unit for the electric drive motor 30 may be provided. It is also possible to connect external sensors, e.g., temperature sensors or the like, to the control device 78 in this manner.

A connector plug receptacle 100 is provided in cover 74 as well. This is also closed towards the internal volume area of the control device housing area 54 by a recess bottom area 102, through which respective connection contacts 104 pass. An interface can be established in this manner to a vehicle or to the data system thereof in order to also provide the control device 78 with the information that is made available in the vehicle itself or with transmitted information, for example, the information that the vehicle was started. The supply of the control device 78 with electric energy can also be embodied in this manner, which requires markedly lower current fluxes than in the case of the electric drive motor 30.

It is obvious that further connection possibilities can be created for connector plugs or these can be positioned or dimensioned differently in both the bottom wall 66 and the cover 74. It is significant that recesses or depressions, which are open towards the outside and in which the corresponding connector plugs can be accommodated at least partly, are present.

By providing the multifunctional housing with four essential functional areas, namely, the blower housing area, motor housing area, control device housing area and spacer formation, a markedly simplified design is created in the side channel blower 10 designed according to the present invention. The multifunctional housing 12 may be manufactured as an integral component according to a casting process, for example, from metal, e.g., aluminum, or a plastic material.

While specific embodiments of the invention have been shown and described in detail to illustrate the application of the principles of the invention, it will be understood that the invention may be embodied otherwise without departing from such principles.

What is claimed is:

1. A vehicle heater side channel blower comprising:

a blower housing area with a delivery channel, which extends in a ring-shaped pattern around a central axis and is open on a first axial side;

a ring-shaped essentially cylindrical motor housing area integral with said blower housing area, said motor housing area receiving an electric drive motor with a drive shaft, wherein a stator area of said electric drive motor is in contact with an inner surface of said motor housing area;

a delivery wheel, which covers said delivery channel on said first axial side of said blower housing area and is carried at a first end of said drive shaft;

a control device housing area integral with said motor housing area with a circumferential wall and with a bottom wall and with an opening located opposite said bottom wall, a central area of said bottom wall of said control device housing area being formed by said motor housing area, said bottom wall further comprising on both sides of said central area lateral bottom wall areas connected to said central area of said bottom wall provided by said motor housing area via respective connection wall areas, said circumferential wall comprising two side walls extending essentially parallel to said central axis and two side walls extending essentially at right angles to said central axis for providing an essentially rectangular configuration defined by said bottom wall on one side, said motor housing area being essentially integrated in said control housing area;

a connector plug receptacle being provided in at least one of said lateral bottom wall areas, said connector plug receptacle comprising a recess bottom area offset with respect to the lateral bottom wall area for providing a setoff open towards an outside; connection contacts passing through said recess bottom area into said connector plug receptacle; and a cover covering said opening.

2. A vehicle heater side channel blower in accordance with claim 1, wherein said motor housing area comprises an outer circumferential surface, one of said lateral bottom wall areas and another one of said lateral bottom wall areas extending to a position beyond said outer circumferential surface.

3. A vehicle heater side channel blower in accordance with claim 1, wherein one of said lateral bottom wall areas and another one of said lateral bottom wall areas extend to a position beyond said motor housing area.

4. A vehicle heater side channel blower in accordance with claim 1, wherein said motor housing area comprises an outer motor housing area surface, said outer motor housing area surface being located at a first distance from said central axis, one of said lateral bottom wall areas extending to a first position, said first position being located at a second distance from said central axis, another one of said lateral bottom wall areas extending to a third position, said third position being located at a third distance from said central axis, wherein said first distance is less than said second distance and said third distance, said two side walls extending essentially parallel to said central axis comprising a first side wall and a second side wall, said two side walls extending essentially at right angles to said central axis comprising a third side wall and a fourth side wall, said first side wall being arranged on one side of said central axis and said second side wall being arranged on another side of said central axis, said first side wall being located opposite said second side wall, said third side wall being located opposite said fourth side wall.

5. A vehicle heater side channel blower comprising:

a blower housing area with a delivery channel, which extends in a ring-shaped pattern around a central axis and is open on a first axial side;

a ring-shaped essentially cylindrical motor housing area integral with said blower housing area, said motor housing area receiving an electric drive motor with a drive shaft, said electric drive motor comprising a stator area, said motor housing area comprising an inner surface, said stator area being in contact with said inner surface;

a delivery wheel, which covers said delivery channel on said first axial side of said blower housing area and is carried at a first end of said drive shaft;

a control device housing area integral with said motor housing area with a circumferential wall and with a bottom wall and with an opening located opposite said bottom wall, said bottom wall comprising a central area, a first lateral bottom wall area, a second lateral bottom wall area, a first connection wall area and a second connection wall area, said motor housing defining at least a portion of said central area, said first lateral bottom wall area being located on one side of said central axis, said second lateral bottom wall area being located on another side of said central axis, said central area being connected to said first lateral bottom wall area via said first connection wall area, said central area being connected to said second lateral bottom wall area via said second connection wall area, said bottom wall defining at least one connector plug receptacle in at least one of said first lateral bottom wall area and said second lateral bottom wall area, wherein said at least one of said first lateral bottom wall area and said second lateral bottom wall area defines at least a portion of said connector plug receptacle, said bottom wall comprising a bottom wall surface portion, said bottom wall surface portion defining at least a portion of said connector plug receptacle, said bottom wall surface portion being offset with respect to said at least one of said first lateral bottom wall area and said second lateral bottom wall area, said connector plug receptacle being open towards an outside, said circumferential wall comprising a first side wall, a second side wall, a third side wall and a fourth side wall, said first side wall and said second side wall extending parallel to said central axis, said third side wall and said fourth side wall extending at right angles to said central axis, said first side wall, said second side wall, said third side wall, said fourth side wall defining an essentially rectangular arrangement, said essentially rectangular arrangement being defined on one side by said bottom wall, said motor housing area being integrated in said control housing area;

connection contacts, at least a portion of said connection contacts being located in said connector plug receptacle; and a cover covering said opening, wherein at least one connector plug receptacle is provided in one of said bottom wall and said closing element.

6. A vehicle heater side channel blower in accordance with claim 5, wherein said first side wall and said second side wall are in contact with said bottom wall, said first side wall being arranged on said one side of said central axis, said second side wall being arranged on said another side of said central axis.

7. A vehicle heater side channel blower in accordance with claim 5, wherein said motor housing area comprises an outer circumferential surface, said first lateral bottom wall area and said second lateral bottom wall area extending to a position beyond said outer circumferential surface.

8. A vehicle heater side channel blower in accordance with claim 5, wherein said first lateral bottom wall area and said second lateral bottom wall area extend to a position beyond said motor housing area.

9. A vehicle heater side channel blower in accordance with claim 5, wherein said motor housing area comprises an outer peripheral motor housing area surface, said outer peripheral motor housing area surface being located at a first distance from said central axis, said first lateral bottom wall area extending to a first position, said first position being located at a second distance from said central axis, said second lateral bottom wall area extending to a third position, said third position being located at a third distance from said central axis, wherein said first distance is less than said second distance and said third distance.

10. A vehicle heater side channel blower in accordance with claim 9, wherein said first side wall is arranged on one side of said central axis and said second side wall is arranged on another side of said central axis, said first side wall being located opposite said second side wall, said third side wall being located opposite said fourth side wall.

11. A vehicle heater side channel blower in accordance with claim 10, wherein said first side wall, said second side wall, said third side wall and said fourth side wall engage said bottom wall.

12. A vehicle heater side channel blower in accordance with claim 5, wherein said first side wall is arranged on one side of said central axis and said second side wall is arranged on another side of said central axis, said first side wall being located opposite said second side wall, said third side wall being located opposite said fourth side wall.

13. A vehicle heater comprising:

a burner area with a combustion chamber; and a side channel blower for delivering combustion air into said combustion chamber of said burner area, said side channel blower comprising:

a blower housing area with a delivery channel, which extends in a ring-shaped pattern around a central axis and is open on a first axial side;

a ring-shaped essentially cylindrical motor housing area integral with said blower housing area, said motor housing area receiving an electric drive motor with a drive shaft, said electric drive motor comprising a stator area, said motor housing area comprising an inner surface, said stator area being in direct contact with said inner surface;

a delivery wheel, which covers said delivery channel on said first axial side of said blower housing area and is carried at a first end of said drive shaft;

a control device housing area integral with said motor housing area with a circumferential wall and with a bottom wall and with an opening located opposite said bottom wall, said bottom wall comprising a central area, a first lateral bottom wall area, a second lateral bottom wall area, a first connection wall area and a second connection wall area, said motor housing defining at least a portion of said central area, said first lateral bottom wall area being located on one side of said central axis, said second lateral bottom wall area being located on another side of said central axis, said central area being connected to said first lateral bottom wall area via said first connection wall area, said central area being connected to said second lateral bottom wall area via said second connection wall area, said bottom wall defining at least one connector plug receptacle in at least one of said first lateral bottom wall area and said second lateral bottom wall area, wherein said at least one of said first lateral bottom wall area and said second lateral bottom wall area defines at least a portion of said connector plug receptacle, said bottom wall comprising a bottom wall surface portion, said bottom wall surface portion defining at least a portion of said connector plug receptacle, said circumferential wall comprising a first side wall, a second side wall, a third side wall and a fourth side wall, said first side wall and said second side wall extending parallel to said central axis, said third side wall and said fourth side wall extending at right angles to said central axis, said first side wall, said second side wall, said third side wall and said fourth side wall defining an essentially rectangular structure, said essentially rectangular structure being defined on one side by said bottom wall, said motor housing area being integrated in said control housing area, said bottom wall surface portion being offset with respect to said at least one of said first lateral bottom wall area and said second lateral bottom wall area, said connector plug receptacle being open towards an outside;

connection contacts, at least a portion of each of said connection contacts being located in said connector plug receptacle; and a cover covering said opening.

14. A vehicle heater in accordance with claim 13, wherein said first side wall and said second side wall engage said bottom wall, said first side wall being arranged on said one side of said central axis, said second side wall being arranged on said another side of said central axis.

15. A vehicle heater in accordance with claim 13, wherein said motor housing area comprises an outer circumferential surface, said first lateral bottom wall area and said second lateral bottom wall area extending to a position beyond said outer circumferential surface.

16. A vehicle heater in accordance with claim 13, wherein said first lateral bottom wall area and said second lateral bottom wall area extend to a position beyond said motor housing area.

17. A vehicle heater in accordance with claim 13, wherein said motor housing area comprises an outer peripheral motor housing area surface, said outer peripheral motor housing area surface being located at a first distance from said central axis, said first lateral bottom wall area extending to a first position, said first position being located at a second distance from said central axis, said second lateral bottom wall area extending to a third position, said third position being located at a third distance from said central axis, wherein said first distance is less than said second distance and said third distance.

18. A vehicle heater in accordance with claim 17, wherein said first side wall is arranged on one side of said central axis and said second side wall is arranged on another side of said central axis, said first side wall being located opposite said second side wall, said third side wall being located opposite said fourth side wall.

19. A vehicle heater in accordance with claim 18, wherein said first side wall, said second side wall, said third side wall and said fourth side wall engage said bottom wall.

20. A vehicle heater in accordance with claim 13, wherein said first side wall is arranged on one side of said central axis and said second side wall is arranged on another side of said central axis, said first side wall being located opposite said second side wall, said third side wall being located opposite said fourth side wall.

* * * * *